US006096253A

United States Patent [19]

Miki et al.

[11] Patent Number: 6,096,253

[45] Date of Patent: Aug. 1, 2000

[54] PROCESS FOR PRODUCING FOUNDRY EXOTHERMIC BODY

[75] Inventors: Masamitsu Miki, Tokyo; Isamu Tunemoto, Chiba-ken, both of Japan

[73] Assignee: Hatsunen Co., Ltd., Tokyo, Japan

[21] Appl. No.: 09/082,726

[22] Filed: May 21, 1998

[30] Foreign Application Priority Data

May 22, 1997 [JP] Japan ..... 9-132651
May 15, 1998 [JP] Japan ..... 10-132783

[51] Int. Cl.[7] ..... B29C 33/40

[52] U.S. Cl. ..... 264/219; 264/299

[58] Field of Search ..... 264/219, 299; 164/37, 40, 527

[56] References Cited

U.S. PATENT DOCUMENTS 3,216,074 11/1965 Harrison .
4,143,022 3/1979 Iyer ..... 164/43
4,848,443 7/1989 Westwood et al. ..... 164/527
4,884,620 12/1989 Jhaveri et al. ..... 164/15
5,602,192 2/1997 Yoshida et al. ..... 523/145
5,738,819 4/1998 Feagin ..... 264/635

*Primary Examiner*—Christopher A. Fiorilla
*Attorney, Agent, or Firm*—Wenderoth, Lind & Ponack, LLP.

[57] ABSTRACT

A process for producing a foundry exothermic body such as an foundry exothermic riser sleeve includes the steps of preparing a raw material mixture whose components include one or more powdered/granular refractories, one or more powdered/granular exothermic materials, one or more powdered/granular oxidants and one or more powdered pro-oxidants, mixing thermosetting phenol resin with the raw material mixture to coat grain surfaces of the raw material mixture with thermosetting phenol resin and obtain a thermosetting phenol resin coated raw material mixture, and using the shell molding process to form and cure the thermosetting phenol resin coated raw material mixture into a foundry exothermic body of prescribed shape.

10 Claims, No Drawings

PROCESS FOR PRODUCING FOUNDRY EXOTHERMIC BODY

BACKGROUND OF THE INVENTION

1. Field of the Invention

This invention relates to a process for producing a foundry exothermic body.

2. Description of the Prior Art

A number of processes are available for making shaped foundry exothermic bodies from a raw material consisting of a mixture of an exothermic material, typically aluminum, an oxidant, typically manganese dioxide, a pro-oxidant, typically powdered cryolite, and a refractory as an aggregate. These include the commonly used hand ramming process, $CO_2$ process and cold box process. For reasons explained below, however, the shell molding process is not used to produce shaped foundry exothermic bodies.

Among processes for making molds for metal casting, the shell molding process is the one that uses a foundry sand such as silica sand as the mold material. For example, a mold material referred to as "resin coated sand" is used which consists of silica sand coated with a thermosetting resin such as phenol resin as a binder. However, the raw material of a foundry exothermic body does not consist solely of refractory materials. It is a mixture also including materials with properties different from those of a refractory, such as the aforesaid exothermic material, typically aluminum, oxidant, typically manganese dioxide, pro-oxidant, typically powdered cryolite, and the like.

When the shell molding process is applied to form a foundry exothermic body using such a mixture as the forming material, the thermosetting resin added as binder must be coated on the forming material in order to minimize the amount thereof added and prevent its segregation. Since the properties of the components making up the mixture are extremely different, however, it is difficult to uniformly disperse the thermosetting resin used as binder in the raw material, In addition, when the coating with the thermosetting resin is effected by the hot process, which involves heating to around 130–160° C., the raw material mixture may ignite and burn during the heating owing to reactions among the exothermic material, the oxidant and the pro-oxidant. This makes it difficult to supply a raw material mixture of constant composition on an industrial basis. Stable production of foundry exothermic bodies having prescribed uniform strength and exothermic property has therefore been difficult.

SUMMARY OF THE INVENTION

This invention is directed to providing a process for producing a foundry exothermic body by the shell molding process that do not have the foregoing problems of the prior art.

To achieve this object, a first aspect of the invention provides a process for producing a foundry exothermic body comprising the steps of preparing a raw material mixture whose components include one or more powdered/granular refractories, one or more powdered/granular exothermic materials, one or more powdered/granular oxidants and one or more powdered pro-oxidants, mixing thermosetting phenol resin with the raw material mixture to coat grain surfaces of the raw material mixture with thermosetting phenol resin and obtain a thermosetting phenol resin coated raw material mixture, and using the shell molding process to form and cure the thermosetting phenol resin coated raw material mixture into a foundry exothermic body of prescribed shape.

In the first aspect of the invention, coating of the grain surfaces of the raw material mixture with thermosetting phenol resin can be effected at a desired temperature between normal room temperature and 160° C.

In the first aspect of the invention, the thermosetting phenol resin coated raw material mixture can be obtained by the steps of dividing the components for preparing the raw material mixture into primary raw material mixture components that do not undergo exothermic or combustion reaction when heated to a temperature of 130–300° C. and secondary raw material mixture components consisting of components other than the primary raw material mixture components, mixing thermosetting phenol resin with the primary raw material mixture components at a temperature of 130–160° C. to coat grain surfaces of the primary raw material mixture components with a molten thermosetting phenol resin layer, mixing liquid thermosetting phenol resin with the secondary raw material mixture components at normal room temperature or a temperature exceeding normal room temperature but not exceeding 130° C. to coat grain surfaces of the secondary raw material mixture components with thermosetting phenol resin, and mixing the thermosetting phenol resin coated primary and secondary raw material mixture components, whereafter the shell molding process can be used to form and cure the obtained thermosetting phenol resin coated raw material mixture into a foundry exothermic body of prescribed shape.

A second aspect of the invention provides a process for producing a foundry exothermic body comprising the steps of preparing a mixture composed 60–70 wt % of one or more powdered/granular refractories, 15–30 wt % of one or more powdered/granular exothermic materials and 5–15 wt % of one or more powdered/granular oxidants, adding to 100 parts of the mixture 1–5 parts of thermosetting phenol resin together with resin setting agent followed by mixing at 130–160° C. to coat grain surfaces of the mixture with a molten thermosetting phenol resin layer and obtain a thermosetting phenol resin coated mixture, and using the shell molding process to form and cure the thermosetting phenol resin coated mixture into a foundry exothermic body of prescribed shape.

A third aspect of the invention provides a process for producing a foundry exothermic body comprising the steps of preparing a mixture composed 60–70 wt % of one or more powdered/granular refractories, 15–30 wt % of one or more powdered/granular exothermic materials and 5–15 wt % of one or more powdered/granular oxidants, adding to 100 parts of the mixture 1–5 parts of thermosetting phenol resin together with resin curing agent followed by mixing at 130–160° C. to coat grain surfaces of the mixture with a molten thermosetting phenol resin layer and obtain a thermosetting phenol resin coated mixture, adding to 100 parts of the thermosetting phenol resin coated mixture 10–20 parts of a mixture obtained by mixing 1–6 wt % of powdered phenol resin, 10–30 wt % of one or more powdered oxidants, 60–75 wt % of one or more finely powdered pro-oxidants and 8–15 wt % of one or more finely powdered exothermic agents, and using the shell molding process to form and cure the resulting mixture into a foundry exothermic body of prescribed shape.

In any of the foregoing processes, the foundry exothermic body can be an exothermic riser sleeve, an exothermic core, an exothermic neckdown core, an exothermic mold, an exothermic pad or a body similar to any of these.

DETAILED DESCRIPTION OF THE PREFERRED EMBODIMENTS

This invention relates to a process for forming a foundry exothermic body such as an exothermic riser, an exothermic core, an exothermic sleeve, an exothermic neckdown core, an exothermic mold or an exothermic pad by the shell molding process.

Raw materials of the thermosetting resin coated powdered/granular composition according to this invention include refractories such as silica sand, zircon sand, alumina sand and dolomite, exothermic materials such as aluminum, ferrosilicon, calcium silicon, magnesium and aluminum-magnesium alloy, oxidants such as manganese dioxide, potassium nitrate, sodium nitrate, potassium chlorate, iron oxide and red iron oxide, and pro-oxidants such as cryolite, calcium fluoride and sodium silicofluoride. The refractories can be used as granules of around 100–150 mesh, and the exothermic materials, oxidants and pro-oxidants as granules, powders of under 100 mesh or mixtures of powders and granules.

The thermosetting resin used to coat the grain surfaces of the components of the powdered, granular or mixed powdered and granular raw materials can be a novolak-type or resol-type phenol resin. The setting agent can be hexamine (hexamethylene tetramine).

Coating of the powdered/granular primary raw material mixture components with thermosetting resin can be conducted, for example, by the method of preheating the primary raw material mixture components to around 130–160° C. and charging them into a mixer, adding hexamethylene tetramine (resin setting agent) and 2–4 wt % of 85–100° C. softening point powdered thermosetting resin thereto, and mixing the result to coat the surfaces of the primary raw material mixture component grains with molten thermosetting resin.

Another method that can be adopted is to mix powdered thermosetting resin dissolved in a solvent or liquid thermosetting resin with the primary raw material mixture components. Still another is to mix liquid thermosetting resin with the primary raw material mixture components at a temperature exceeding normal room temperature, e.g., at 40–70° C.

The invention will be explained with reference to specific examples.

EXAMPLE 1

To 100 parts of a primary raw material mixture composed of

| | |
|---|---|
| Foundry silica sand | 40 wt % |
| Zircon sand | 25 wt % |
| Aluminum powder | 25 wt % |
| Iron oxide ($Fe_3O_4$) | 8 wt % |
| Potassium nitrate | 2 wt % |

was added 3 parts of novolak-type thermosetting phenol resin. The result was mixed at 130–160° C. to coat the grain surfaces of the primary raw material mixture with the resin. The obtained resin coated primary raw material mixture was used to form a foundry exothermic riser by the shell molding process.

The granularity of the silica sand, zircon sand, aluminum powder and iron oxide in the resin coated primary raw material mixture was made not less than 100 mesh to reduce the amount of fine powder contained in the mixture. As this prevented any loss of the raw material by dust collection/removal owing to heat generation and dust collection during the heating step, there could be obtained a foundry exothermic riser exhibiting a strength of 30–35 kgf/cm$^2$. The foundry exothermic riser thus entailed no problem regarding practical utility from the aspect of strength, despite being formed by the shell molding process.

EXAMPLE 2

To 100 parts of a primary raw material mixture composed of

| | |
|---|---|
| Foundry silica sand | 40 wt % |
| Zircon sand | 25 wt % |
| Aluminum powder | 25 wt % |
| Iron oxide ($Fe_3O_4$) | 10 wt %, |

all of a granularity of not less than 100 mesh, was added 3 parts of novolak-type thermosetting phenol resin. The result was mixed and kneaded at 130–160° C. to coat the grain surfaces of the primary raw material mixture with the resin and obtain a thermosetting phenol resin coated primary raw material mixture.

To 100 parts of the obtained thermosetting phenol resin coated primary raw material mixture was added 10–15 parts of a secondary raw material powder composed of

| | |
|---|---|
| Phenol resin | 5 wt % |
| Potassium nitrate | 20 wt % |
| Cryolite of under 100 mesh | 40 wt % |
| Iron oxide ($Fe_3O_4$) of under 100 mesh | 25 wt % |
| Aluminum fine powder of under 100 mesh | 10 wt % |

and the result was mixed. The obtained mixture was used to form an exothermic neckdown core by the shell molding process. The shaped body exhibited a strength of 20–30 kgf/cm$^2$, which is near the 30–40 kgf/cm$^2$ strength of ordinary shell molds and superior to the 20 kgf/cm$^2$ strength of an exothermic body formed by the $CO_2$ process. The strength was sufficient for practical use.

The inclusion of nitrate and finely powdered aluminum, cryolite and iron oxide in accordance with Example 2 enhances the uniformity of the raw material mixture composition, lowers the ignition temperature of the shaped body and increases its combustion rate compared with the case of Example 1. Like the foundry exothermic bodies in common use, therefore, an exothermic pad, exothermic core, exothermic mold, exothermic neckdown core, exothermic riser sleeve or the like formed using raw material mixture is completely adequate for use as part of a foundry mold.

EXAMPLE 3

To 100 parts of a primary raw material mixture composed of

| | |
|---|---|
| Foundry silica sand | 35 wt % |
| Zircon sand | 25 wt % |
| Granular aluminum | 25 wt % |
| Iron oxide ($Fe_3O_4$) | 15 wt %, |

all of not less than 100 mesh, was added 1 part hexamine as resin setting agent and 3 parts of phenol resin. The result was mixed at 130–160° C. to obtain a thermosetting phenol resin coated primary raw material mixture.

Separately from this process, liquid thermosetting resin was added to a mixture of finely powdered aluminum and cryolite of under 100 mesh. The result was mixed to obtain a thermosetting resin coated secondary raw material powder. The thermosetting resin coated secondary raw material powder was added to the thermosetting resin coated primary raw material mixture to obtain a thermosetting resin coated raw material mixture that was used to form an exothermic sleeve by the shell molding process. The exothermic sleeve exhibited a strength of about 35–45 kgf/cm$^2$, which is comparable with the strength of an ordinary shell mold and sufficient for practical use.

In accordance with this example, mixture components such as finely powdered aluminum, nitrate, red iron oxide and cryolite, which are liable to undergo exothermic reaction and combustion if present in the primary raw material mixture at the time of effecting resin coating of the primary raw material mixture at 130–160° C. (hot process), can be processed separately of the primary raw material mixture by a resin coating process effected at normal room temperature or, for example, at 40–70° C. (cold process or warm process) and the obtained thermosetting resin coated mixture can thereafter be mixed with the primary raw material mixture as a secondary raw material mixture. This improves the safety of the work while enabling production of a foundry exothermic body with a low ignition temperature like that of an ordinary exothermic material.

When a foundry exothermic body such as an exothermic neckdown core or an exothermic pad produced by the shell molding process in accordance with this invention is used in iron or steel casting, no gas induced defects occur in the casting surface in contact therewith. The invention therefore provides an outstanding effect of enabling securement of an excellent casting surface of superb appearance. Further, when an exothermic neckdown core according to the invention is used, productivity is markedly increased because the opening of the core can be made smaller to facilitate break-off of the riser.

Moreover, since the invention enables the shell molding process to use a thermosetting resin coated raw material containing exothermic components for high-volume production of high-strength foundry exothermic bodies of desired shape capable of manifesting uniform and excellent exothermic effect, it reduces casting production cost and, as such, has very great industrial utility.

What is claimed is:

1. A process for producing a foundry exothermic shaped body comprising the steps of:

preparing a raw material mixture whose components include one or more powdered/granular refractories, one or more powdered/granular exothermic materials, one or more powdered/granular oxidants and one or more powdered pro-oxidants, mixing a thermosetting phenol resin with the raw material mixture to coat grain surfaces of the raw material mixture with the thermosetting phenol resin and obtain a thermosetting phenol resin coated raw material mixture, and using a shell molding process to form and cure the thermosetting phenol resin coated raw material mixture into a foundry exothermic shaped body.

2. A process according to claim 1, wherein coating of grain surfaces of the raw material mixture with the thermosetting phenol resin is effected at a temperature between normal room temperature and 160° C.

3. A process according to claim 2, wherein the foundry exothermic shaped body is an exothermic riser sleeve, an exothermic core, an exothermic neckdown core, an exothermic mold, or an exothermic pad.

4. A process according to claim 1, wherein the foundry exothermic body is an exothermic shaped riser sleeve, an exothermic core, an exothermic neckdown core, an exothermic mold, or an exothermic pad.

5. A process for producing a foundry exothermic shaped body from a raw material which components include one or more powdered/granular refractories, one or more powdered/granular exothermic materials and one or more powdered/granular oxidants comprising the steps of:

dividing the components for preparing the raw material mixture into a primary raw material mixture of components that do not undergo an exothermic or a combustion reaction when heated to a temperature of 130–300° C. and a secondary raw material mixture components consisting of components other than the primary raw material mixture components, mixing a thermosetting phenol resin with the primary raw material mixture components at a temperature of 130–160° C. to coat grain surfaces of the primary raw material mixture components with a molten thermosetting phenol resin layer, mixing a liquid thermosetting phenol resin with the secondary raw material mixture components at normal room temperature or a temperature exceeding normal room temperature but not exceeding 130° C. to coat grain surfaces of the secondary raw material mixture components with the liquid thermosetting phenol resin, and mixing the thermosetting phenol resin coated primary and secondary raw material mixture components, and using a shell molding process to form and cure the obtained thermosetting phenol resin coated raw material mixture into a foundry exothermic shaped body.

6. A process according to claim 5, wherein the foundry exothermic shaped body is an exothermic riser sleeve, an exothermic core, an exothermic neckdown core, an exothermic mold, or an exothermic pad.

7. A process for producing a foundry exothermic shaped body comprising the steps of:

preparing a mixture comprising 60–70 wt % of one or more powdered/granular refractories, 15–30 wt % of one or more powdered/granular exothermic materials and 5–15 wt % of one or more powdered/granular oxidants, adding to 100 parts of the mixture 1–5 parts of thermosetting phenol a resin together with resin setting agent followed by mixing at 130–160° C. to coat grain surfaces of the mixture with a molten thermosetting phenol resin layer and obtain a thermosetting phenol resin coated mixture, and using a shell molding process to form and cure the thermosetting phenol resin coated mixture into a foundry exothermic shaped body.

8. A process according to claim 7, wherein the foundry exothermic shaped body is an exothermic riser sleeve, an exothermic core, an exothermic neckdown core, an exothermic mold, or an exothermic pad.

9. A process for producing a foundry exothermic shaped body comprising the steps of:

preparing a mixture comprising 60–70 wt % of one or more powdered/granular refractories, 15–30 wt % of one or more powdered/granular exothermic materials and 5–15 wt % of one or more powdered/granular oxidants, adding to 100 parts of the mixture 1–5 parts of a thermosetting phenol resin together with a resin curing agent followed by mixing at 130–160° C. to coat grain surfaces of the mixture with a molten thermosetting phenol resin layer and obtain a thermosetting phenol resin coated mixture, adding to 100 parts of the thermosetting phenol resin coated mixture 10–20 parts of a thermosetting phenol resin coated mixture obtained by mixing, at normal room temperature or a temperature exceeding normal room temperature but not exceeding 130° C., 1–6 wt % of liquid or powdered phenol resin, 10–30 wt % of one or more powdered oxidants, 60–75 wt % of one or more finely powdered pro-oxidants and 8–15 wt % of one or more finely powdered exothermic agents, and using a shell molding process to form and cure the resulting mixture into a foundry exothermic shaped body.

10. A process according to claim 9, wherein the foundry exothermic shaped body is an exothermic riser sleeve, an exothermic core, an exothermic neckdown core, an exothermic mold, or an exothermic pad.

* * * * *